United States Patent [19]

Vanassche et al.

[11] 4,045,228

[45] Aug. 30, 1977

[54] DIRECT POSITIVE EMULSIONS CONTAINING FOGGED, MONODISPERSED SILVER HALIDE GRAINS HAVING MORE THAN 10 MILE % IODIDE

[75] Inventors: Willy Joseph Vanassche, Kontich; Herman Alberik Pattyn, Kapellen, both of Belgium; Otto Lapp, Leverkusen; Sieghart Klotzer, Cologne; Erik Moisar, Cologne-Flittard, all of Germany

[73] Assignee: AGFA-GEVAERT N.V., Mortsel, Belgium

[21] Appl. No.: 417,500

[22] Filed: Nov. 20, 1973

[51] Int. Cl.[2] ..... G03C 5/24; G03C 1/28

[52] U.S. Cl. ..... 96/64; 96/107; 96/108; 96/66.1; 96/120

[58] Field of Search ..... 96/64, 107, 108, 120, 96/66.1

[56] References Cited

U.S. PATENT DOCUMENTS

| | | | |
|---|---|---|---|
| 3,320,069 | 5/1967 | Illingsworth | 96/107 |
| 3,367,778 | 2/1968 | Berriman | 96/107 |
| 3,531,290 | 9/1970 | Litzerman | 96/107 |
| 3,647,455 | 3/1972 | Burt et al. | 96/64 |
| 3,740,226 | 6/1973 | Dappen | 96/64 |
| 3,759,713 | 9/1973 | Florens | 96/108 |

*Primary Examiner*—Won H. Louie, Jr.
*Attorney, Agent, or Firm*—A. W. Breiner

[57] ABSTRACT

Direct positive silver halide emulsions are provided which contain fogged homodisperse silver halide grains having a silver iodide content of more than 10 mole % and at most 20 mole % relative to the total amount of silver halide. These emulsions have higher sensitivity than corresponding fogged emulsions with less silver iodide content.

13 Claims, No Drawings

DIRECT POSITIVE EMULSIONS CONTAINING FOGGED, MONODISPERSED SILVER HALIDE GRAINS HAVING MORE THAN 10 MILE % IODIDE

The present invention relates to photographic materials comprising at least one direct-positive silver halide emulsion layer of improved photosensitivity.

It is known that direct-positive images can be obtained with certain types of photographic silver halide emulsions without previously forming a negative silver image. For example, the silver halide grains are fogged by an overall exposure to actinic radiation or by an overall chemical fogging, e.g. by means of reducing agents, before or after they are coated on a support. Upon image-wise exposure of the prefogged emulsions the development centres formed by said fogging are destroyed at the exposed areas and remain at the unexposed areas. By subsequent conventional development by means of silver halide developers a direct-positive image is formed.

A particularly suitable class of direct-positive silver halide emulsions consists of direct-positive silver halide emulsions comprising electron traps. This class includes emulsions comprising compounds acting as electron acceptors or desensitizers such as desensitizing dyes, which are absorbed to the surface of the fogged silver halide grains. It also includes emulsions that comprise silver halide grains having in their interior centres promoting the deposition of photolytic silver, the said centres forming the electron traps.

The silver halides used in the light-sensitive silver halide emulsions are silver bromide, silver chloride and silver chlorobromide, which may contain a small quantity of silver iodide to increase the sensitivity.

In accordance with the present invention a photographic material is provided which comprises at least one layer of a direct-positive radiation-sensitive emulsion containing fogged homodisperse silver halide grains wherein the silver halide grains have a silver iodide content of more than 10 mol% and at most about 20 mole % relative to the total amount of silver halide. The silver iodide content is preferably comprised between about 12 mole % and about 20 mole %.

The fogged direct positive emulsions to be used in accordance with the invention have a substantially higher sensitivity and in most cases also a higher maximum density than those emulsions which are free from iodide or have only a low silver iodide content. This finding is all the more surprising since it is known that in conventional negative silver halide emulsions that have not been fogged, although the addition of silver iodide in small quantities of only a few percent may increase the sensitivity, higher silver iodide contents of more than 10% have the effect of considerably reducing the sensitivity.

The silver halide emulsions to be used according to the invention are homodisperse emulsions with a narrow grain size distribution. Preferably about 95% by weight of the silver halide grains have a diameter that deviates by not more than 40% or preferably not more than 30% from the average grain diameter.

Direct positive silver halide emulsions in which the silver halide grains have an average diameter of less than about 1 micron, preferably less than 0.5 micron, are preferred. The silver halide grains may have any of the known forms, e.g. cubical, octahedral or also the tetradecahedral mixed form.

According to a preferred embodiment of the present invention emulsions are used having silver halide grains containing interior electron traps. They comprise silver halide grams having internal centres promoting the deposition of photolytic silver. Such direct-positive silver halide emulsions have improved sensitivity as shown by E. Moisar and S. Wagner in "Berichte der Bunsengesellschaft fur physikalische Chemie" 67 (1963) 356–359. Photographic emulsions comprising in the interior of the silver halide grains centres promoting the deposition of photolytic silver can be prepared, e.g., as described in the U.K. Patent Specification 1,027,146 of Agfa A.G. filed Aug. 30, 1963. For this purpose, a homodisperse fine-grain silver halide emulsion with narrow grain size distribution is made first, preferably by the double jet silver halide precipitating technique. These fine silver halide grains will serve as the cores for the final emulsion.

The silver halide cores thus formed are then treated so as to produce centres that promote the deposition of photolytic silver (electron traps) on the cores. For this purpose, the cores may be treated chemically or physically according to any of the known procedures for producing ripening nuclei i.e. latent image nucleating centres. Such procedures are described, e.g., by A. Hautot and H. Sauvenier in "Sci. et Ind Phot.", Vol.XXVIII, January 1957, p.1–23 and 57–65.

The ripening nuclei can be formed by chemical sensitization by means of noble metal compounds, especially gold or iridium compounds, e.g. the alkaline metal salts of the following noble metal ions $[Au(S_2O_3)_2]^{3-}$, $[Au(SCN)_2]^{-}$, $[IrX_6]^{3-}$ and $[IrX_6]^{4-}$ wherein X is halogen, by means of sulphur compounds, e.g. thiosulphates, or by means of both noble metal compounds and sulphur compounds. Ripening of the silver halide cores can also be effected by means of reducing agents, e.g. hydrazine, thiourea or tin(II) chloride, optionally together with noble metal compounds.

Electron-traps can further be provided by treating the silver halide cores with aqueous solutions of salts of polyvalent metals e.g. of the trivalent bismuth.

It is also possible to use the compounds suitable for the formulation of the electron traps, e.g. the chemical sensitizers referred to hereinbefore, during the precipitation of the fine-grain silver halide i.e. during the formation of the cores for the final silver halide emulsion. In this way, the electron traps are distributed statistically in the interior of the cores contrary to when the compounds are added after the formation of the fine-grain silver halide where the electron-traps are formed substantially at the surface of the cores. After the formation of the cores having centres promoting the deposition of photolytic silver, silver halide precipitation is continued to form around the cores an outer shell of silver halide.

Another type of preferred direct-positive silver halide emulsions for use in accordance with the present invention are emulsions that comprise no interior ripening nuclei but exterior electron-traps by the presence of one or more electron-accepting or desensitizing compounds as described e.g. in the U.K. Patent Specification 723,019. By adsorption of these electron acceptors to the surface of the silver halide grains improved photosensitivity is obtained.

Other direct positive emulsions which are suitable for this invention have been described in the German Patent Specifications 606,392 and 642,222 and in the U.K. Patent Specifications 581,773 and 655,009. The emulsions may also contain mercury salts or thallium salts as described in the published German Patent Application 1,622,256.

Fogging of the silver halide grains can occur in any suitable known manner, which consists of providing the silver halide grains with silver nuclei and/or nuclei of a metal more electropositive than silver including gold, platinum, palladium, iridium, etc.

The silver halide grains may be provided with silver nuclei e.g. by an overall uniform exposure to actinic radiation and preferably by reduction sensitization, e.g. by silver halide precipitation or digestion in high pH and/or low pAg conditions e.g. as described by Wood, J.Phot. Sci. 1 (1953) 163, or by treatment with reducing agents e.g. tin(II) salts e.g. tin(II)chloride, tin complexes and tin chelates of the (poly)amino(poly)carboxylic acid type as described in the U.K. Pat. No. 1,209,050 filed Dec 27, 1967 by Agfa-Gevaert N.V., formaldehyde, hydrazine, hydroxylamine, sulphur compounds such as thiourea dioxide, phosphonium salts such as tetra(hydroxymethyl)-phosphonium chloride, polyamines such as diethylenetriamine, bis(p-aminoethyl)-sulphide and its water-soluble salts, etc.; preferred reducing agents are thiourea dioxide and tin(II) chloride.

The silver halide grains can also be provided with nuclei of a metal more electropositive than silver, for example, by treatment of the silver halide grains (which may have been provided with silver nuclei) with a compound of a metal more electropositive than silver, preferably in the form of water-soluble salts e.g. potassium chloroaurate, gold(III) chloride, ammonium hexachloropalladate, potassium chloroiridate and the like. The treatment with a gold compound may occur by means of a mixture of a water-soluble noble metal compound e.g. gold(III) chloride and thiocyanates forming complexes with gold and having a solvent action on the silver halide grains, e.g. alkali metal and ammonium thiocyanates.

In the formation of direct-positive silver halide emulsions, fogging of the silver halide grains is very suitably effected by reduction sensitization e.g. by high pH and/or low pAg digestion conditions or by means of a reducing agent e.g. thiourea dioxide together with a compound of a metal more electropositive than silver, especially a gold compound. The reducing agent is preferably used initially and the gold compound subsequently. However, the reverse order can be used or both compounds can be used simultaneously.

The degree of fogging of the direct-positive silver halide emulsions may vary within a very wide range. It is generally sufficient to use about 0.0005 to about 0.06 milliequivalents of reducing agents and about 0.001 to about 0.01 millimoles of the noble metal salt per mole of silver halide as described in the published German Patent Application 1,547,790. If the emulsions have been fogged too heavily, they may subsequently be treated with a bleaching agent in known manner to adjust the light sensitivity of the direct positive emulsions to the optimum level.

As is known in the art, the degree of fogging not only depends on the concentration of the fogging agents used but also on the pH, the pAg, the temperature, and the duration of the fogging treatment. High photographic speeds are obtained at low degrees of fogging as is illustrated in the U.S. Pat. Specification 3,501,307 of Bernard D. Illingsworth issued Mar. 17, 1970 and the U.K. Pat. No. Application No. 7742/72 filed Feb. 18, 1972 by Agfa-Gevaert N.V.

In the U.S. Pat. Specification 3,501,307 as mentioned above direct-positive silver halide emulsions comprising fogged silver halide grains and a compound accepting electrons are described wherein the grains are fogged to such an extent that a test portion of the emulsion when coated on a support to give a maximum density of at least about 1, upon processing for 6 minutes at about 20° C in a developer of the composition given hereinafter shows a maximum density at least about 30% higher than the maximum density of an identical test portion processed for 6 minutes at about 20° C in such developer after bleaching for about 10 minutes at about 20° C in a bleaching bath having the composition given hereinafter.

| | |
|---|---|
| Bleaching bath | |
| potassium cyanide | 50 mg |
| glacial acetic acid | 3.47 ml |
| sodium acetate | 11.49 g |
| potassium bromide | 119 mg |
| water to make | 1 litre |
| Developer | |
| N-methyl-p-aminophenol sulphate | 2.5 g |
| sodium sulphite | 30.0 g |
| hydroquinone | 2.5 g |
| sodium metaborate | 10.0 g |
| potassium bromide | 0.5 g |
| water to make | 1 liter |

According to the copending U.K. Pat. Application No. 7742/72 as mentioned above the silver halide grains are fogged to such an extent that a test portion of the emulsion, when coated on a support at a ratio of 0.50 g to 5.50 g of silver per sq.m gives a density of less than 0.50 upon processing without exposure for 6 min. at 20° C in the above developer and an identical test portion thereof when coated in an identical way gives a density of at least twice the value of the density of the first test portion and a density of at least 0.50 upon processing without exposure for 3 minutes at 20° C in a developer of the following composition:

| | |
|---|---|
| hydroquinone | 15 g |
| 1-phenyl-3-pyrazolidinone | 1 g |
| trisodium salt of ethylenediamine-tetraacetic acid | 1 g |
| anhydrous sodium carbonate | 30 g |
| anhydrous sodium sulphite | 70 g |
| 40 % aqueous sodium hydroxide | 16 ml |
| water to make | 1 litre (pH : 11) |

As a consequence, the terms "fogged" and "fogging" as used herein are employed in a very broad sense so that the very low degrees of fogging as defined in the above copending British Patent Application are also embraced. This means that, in accordance with the present invention, fogging is effected to such extent that a test portion of the emulsion when coated on a support at a coverage of 0.50 to 5.50 g of silver per sq.m., gives a density of at least 0.50 upon processing for 3 minutes at 20° C in the above latter developer composition.

As already indicated above, the sensitivity to light of fogged direct positive emulsions that are free from internal nuclei can be improved by the addition of desensitizers that are adsorbed to the surface of the grain and act as electron traps. According to Sheppart et al J. Phys. Chem. 50 (1946) 210, Stanienda, Z. Phys. Chem. (NF) 32 (1962) 238, and Dahne, Wiss. Phot. (1969) 161, desensitizers are dyestuffs whose cathodic polarographic half-wave potential, measured against the calomel electrode, is more positive than −1.0 V. Such compounds have also been described in the U.S. Pat. Specifications 3,501,305, 3,501,306, and 3,501,307 all of Bernard D. Illingsworth issued Mar. 17, 1970. The sensitizers described in the German Pat. Specification 1,153,246 filed Apr. 11, 1962 by Agfa A.G. and U.S. Pat. Specification 3,314,796 of Johannes Gotze, August Randolph and Oskar Riester issued Apr. 18, 1967 are also suitable for this purpose as well as imidazo-quinoxaline dyestuffs, e.g. those described in the Belgian Pat. Specification 660,253 filed Feb. 25, 1965 by Kodak Co.

It is known to characterize these electron-accepting or desensitizing compounds by means of their polarographic half-wave potential. Electron acceptors suitable for use in the direct positive silver halide emulsions of the present invention have an anodic polarographic half-wave potential and a cathodic polarographic half-wave potential that when added together give a positive sum. Methods of determining these polarographic half-wave potentials have been described, e.g., in the U.S. Pat. Specifications 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

In the preparation of the direct-positive photographic silver halide emulsion for use in accordance with the present invention gelatin is preferably used as binder for the silver halide grains. However, the gelatin may be wholly or partly replaced by other natural hydrophilic colloids, e.g. albumin, zein, agar-agar, gum arabic, alginic acid and derivatives thereof, e.g. salts, amides and esters, starch and derivatives thereof, cellulose derivatives e.g. cellulose ethers, partially hydrolysed cellulose acetal carboxymethyl cellulose etc. or synthetic hydrophilic resins, for example polyvinyl alcohol, polyvinyl pyrrolidone, homo- and copolymers of acrylic and methacrylic acid or derivatives e.g. esters, amides and nitriles, vinyl polymers e.g. vinyl ethers and vinyl esters.

The direct-positive silver halide emulsions for use in accordance with the present invention may comprise all kinds of emulsion ingredients suitable for direct-positive emulsions. They may comprise e.g. speed-increasing compounds such as polyalkylene glycols, cationic surface-active agents of the ammonium, sulphonium and phosphonium type, thioethers, etc. They may further comprise known antifoggants and stabilizers, which include thiazolium salts, azaindenes, e.g. hydroxytetraazaindenes such as 5-methyl-7-hydroxy-s-triazolo[1,5-a]pyrimidine, mercury compounds e.g. mercury oxide, mercury chloride, mercury cyanide, nitroindazoles, nitrobenzimidazoles, mercaptotetrazoles such as 1-phenyl-5-mercaptotetrazole, etc. They may comprise as compounds increasing the reversal speed of direct positive silver halide emulsions selenium compounds of the kind described in the Belgian Pat. No. 763,827 filed Mar. 5, 1971 by Gevaert-Agfa N.V., quinone compounds of the kind described in the U.S. Defensive Publication No. T883,031 of Paul B. Gilman Jr., and Frederik J. Rauner issued Feb. 23, 1971, polymeric as well as non-polymeric 1,2- and 1,4-dihydroxybenzene compounds e.g. 2-chlorohydroquinone, tetrachlorohydroquinone, pyrocatechol, the polymeric reaction product of quinone with ammonia prepared as described in Wysokomolekularnye Soedinenya, 1968, Part A(X), Nr.8, p. 1890 by Berlin et al in which the hydroquinone or quinone recurring units are interlinked by —NH— units, and other related polymeric compounds having interlinking —S— and —O— units, as well as polymeric compounds comprising hydroquinone substituents, e.g. those described in the U.S. Pat. Specifications 3,165,495 of Lloyd D. Taylor issued Jan. 21, 1965 and 3,186,970 of Normal W. Schuler issued June 1, 1965.

Spectrally sensitizing dyes that are not electron-accepting such as e.g. cyanines, merocyanines, complex (trinuclear) cyanines, complex (trinuclear) merocyanines, styryls and hemicyanines may also be present in the emulsion.

The direct-positive emulsions may also contain compounds increasing the blue sensitivity, e.g. according to the U.K. Pat. Specification 1,186,718. Compounds of this type have an anodic polarographic potential of less than 0.85 and a cathodic polarographic potential with a value that is more negative than −1.0. Suitable sensitizers have also been described e.g. in the U.S. Pat. Specification 3,531,290.

Further, colour couplers may be incorporated into the direct positive emulsions employed in the present invention. Particularly suitable are colour couplers showing a low halogen-accepting character, which can be determined by the test described by R. P. Held in Phot. Sci. Eng. Vol. 11 (1967) p. 406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through "halogen acceptance" by the colour coupler. Colour couplers as well as other emulsion ingredients including binding agents for the silver halide that do not delay or do not substantially delay the potential rise are particularly suitable for use in direct-positive silver halide emulsions.

The colour couplers can be incorporated into the direct-positive photographic silver halide emulsion using any suitable technique known to those skilled in the art for incorporating colour couplers in silver halide emulsions. For example, water-soluble colour couplers e.g. those containing one or more sulpho or carboxyl groups (in acid or salt form) can be incorporated from an aqueous solution, if necessary, in the presence of alkali and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent can be removed afterwards by evaporation.

The silver halide emulsion layer and other hydrophilic colloid layers of a direct-positive photographic material employed in accordance with the present invention may be hardened by means of organic or inorganic hardeners commonly employed in photographic silver halide elements, e.g., the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole and coumarin brightening agents, light-absorbing materials and filter dyes, mordanting agents for anionic compounds, etc.

The sensitivity and stability of the direct positive silver halide emulsions can also be improved by reducing their pH before casting, preferably to about 5, and/or increasing the pAg of the emulsion, preferably to a value which corresponds to an EMF of +30 mV or less (silver against saturated calomel electrode) in accordance with the U.K. Patent Application 32,889/72.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to use paper coated with α-olefin polymers e.g. paper coated with polyethylene, polypropylene, ethylene-butene copolymers etc.

Development of the exposed direct-positive silver halide emulsions of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents. The exposed direct-positive emulsions may be developed to produce direct-positive black-and-white images or they may be developed to produce direct-positive colour images by means of aromatic primary amino colour developing agents, more particularly the known p-phenylenediamine developing agents, in the presence of colour couplers, which are incorporated in the emulsion or in the developing composition.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives.

It may be advantageous to effect development of the exposed direct-positive silver halide emulsions with compositions substantially free from halide ions. Development with developing compositions substantially free from halide ions is particularly favourable in order to obtain high maximum densities for direct-positive silver halide emulsions, the silver halide grains of which have been fogged to a very low degree.

One or more developing agents may be incorporated in the direct-positive photographic element. They may be incorporated into the silver halide emulsion itself and/or elsewhere in the photographic element. Development can then be effected by means of an alkaline processing solution called development activator solution, which is substantially free of developing agents.

During the processing of the photographic materials of the invention, the high silver iodide content may give rise to staining of the processing solutions. Therefore, the processing solution used to effect development of the exposed direct-positive silver halide emulsion and which comprises or does not comprise one or more developing agents is preferably supplied in an amount that suffices for the treatment of exactly one piece of light-sensitive element. Therefore, it is preferred to employ a single-use bath. A bath of this type offers the advantage that ageing and contamination of the bath composition are eliminated. For one-time use the processing solution is preferably relatively viscous so as to be easily controlled when spread. Viscous processing solutions can be obtained by addition of a thickening agent, e.g. a water-soluble polymer. The film-forming plastic may be any of the high molecular weight polymers that are stable to alkali and that are soluble in aqueous alkaline solutions e.g. hydroxyethylcellulose, starch or gum, polyvinyl alcohol, the sodium salts of polymethacrylic acid and polyacrylic acid, sodium alginate, sodium carboxymethyl cellulose etc. The relatively viscous processing composition may be confined within a container, which is ruptured at the moment of development as is done, for example, in the well-known silver complex diffusion transfer process for in-camera processing.

Photographic materials, which contain at least one of the direct positive silver salt emulsion layers according to the invention may be used for various photographic purposes, e.g. as materials with a steep gradation for reprographic purposes, a direct positive X-ray films, for producing direct positive colour images, e.g. by the silver dye bleaching process or the dye diffusion process, or for producing photographic colour images by conventional methods of chromogenic development.

In these direct positive emulsions, the grains may also be provided with a thin protective envelope to improve the fog stability in accordance with published German Patent Application 2,216,075.

EXAMPLE 1

Several homodisperse direct positive emulsions are prepared with cubic silver iodobromide with an average grain diameter of about 0.1 micron. They vary in their silver iodide contents as shown in Table 1. During precipitation, the emulsion was kept at pH 3, pAg 8.2 and a temperature of 40° C. The pAg is thereafter adjusted to 10 and the emulsion is solidified by cooling, size reduced and washed with cold water.

The emulsions are then chemically fogged by ripening at 60° C, pH 7 and pAg 8.2. The ripening times and the quantities of thiourea dioxide used as reducing agent are shown in Table I. In order to obtain direct positive silver halide emulsions, which are suitable in practice, the quantity of thiourea dioxide must be adapted in each case to the increasing iodide content of the emulsions; reduction of the silver halide is thereby considerably facilitated.

Table I

| Emulsion | mole % of iodide | Time for precipitating the silver halide | mg of thiourea dioxide per mole of silver halide | Ripening time |
|---|---|---|---|---|
| I | 0 | 30 minutes | 25 | 5 hours |
| II | 2 | 34 minutes | 23 | 5 hours |
| III | 4 | 38 minutes | 15 | 4 hours, 30 min. |
| IV | 8 | 46 minutes | 7 | 4 hours |
| V | 10 | 50 minutes | 6 | 5 hours |
| VI | 15 | 50 minutes | 5 | 5 hours |
| VII | 20 | 56 minutes | 4 | 5 hours |

After the addition of 600 mg of Pinacryptol yellow as desensitizer and 600 mg of the optical sensitizer of the following formula:

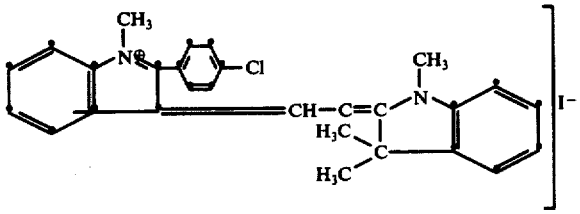

per mole of silver halide, the emulsions are coated on a cellulose acetate layer support so that when dry, the layer contains 3.75 g of silver and 3.75 g of gelatin per m2.

The individual samples are exposed in a sensitometer and developed for 2 minutes at 20° C in a developer of the following composition:

| | |
|---|---|
| p-Monomethyl-aminophenol sulphate | 1.5 g |
| sodium sulphite | 50 g |
| hydroquinone | 6 g |
| sodium carbonate (anhydrous) | 32 g |
| potassium bromide | 2 g |
| water | 1000 ml |

The developed samples are fixed, washed and dried in the usual manner.

The results of sensitometric determinations are summarized in Table II. Sensitivity is determined at a density of 0.1 below the maximum density. The sensitivity values given are relative values, taking the sensitivity of pure silver bromide emulsion to be 100.

Table II

| Emulsion | Relative sensitivity | $D_{min}$ | $D_{max}$ |
|---|---|---|---|
| I | 100 | 0.04 | 1.65 |
| II | 275 | 0.05 | 1.78 |
| III | 2200 | 0.04 | 1.95 |
| IV | 12800 | 0.05 | 2.20 |
| V | 20000 | 0.05 | 2.00 |
| VI | 50000 | 10.04 | 2.30 |
| VII | 45500 | 0.04 | 2.80 |

Samples VI and VII according to the invention have improved sensitivity as well as higher maximum densities.

EXAMPLE 2

Several homodisperse direct positive silver iodobromide emulsions are prepared with cubic silver iodobromide as described in Example 1. These have an average grain diameter of 0.1 micron and differ in their silver iodide content.

The emulsions are fogged by ripening in the presence of 12 mg of sodium chloroaurate per mole of silver halide at 60° C, pH 7 and low pAg values (see Table III). The ripening times are also shown in Table III.

Table III

| Emulsion | % of Iodide | pAg | Ripening time |
|---|---|---|---|
| VIII | 0 | 4 | 2 hours, 30 minutes |
| IX | 5 | 5.15 | 2 hours, 30 minutes |
| X | 10 | 5.32 | 2 hours, 30 minutes |
| XI | 15 | 5.5 | 1 hour, 30 minutes |

The following results are obtained after coating, exposure and development (as in Example 1):

Table IV

| Emulsion | Relative sensitivity | $D_{min}$ | $D_{max}$ |
|---|---|---|---|
| VIII | 100 | 0.20 | 1.24 |
| IX | 1230 | 0.04 | 1.33 |
| X | 2140 | 0.04 | 1.70 |
| XI | 3400 | 0.06 | 1.66 |

EXAMPLE 3

Several emulsions are prepared which correspond to emulsions I, III, V and VI in Example 1. The emulsions are coated and exposed as described in Example 1 and then developed for 1 minute, 30 seconds in a thick liquid developer paste. A developer of the composition indicated below is thickened with sufficient carboxymethylcellulose to produce a paste having a viscosity of 750 cP at 20° C:

| | |
|---|---|
| hydroquinone | 15 g |
| 1-phenyl-3-pyrazolidinone | 1 g |
| trisodium salt of ethylene diamino-tetraacetic acid | 1 g |
| anhydrous sodium carbonate | 30 g |
| 40% aqueous sodium hydroxide solution | 16 ml |
| made up with water to (pH = 11) | 1 litre |

The sensitometric results are shown in Table V below:

Table V

| Emulsion | % of iodide | Relative Sensitivity | $D_{min}$ | $D_{max}$ |
|---|---|---|---|---|
| I | 0 | 100 | 0.09 | >4.00 |
| III | 4 | 1260 | 0.11 | >4.00 |
| V | 10 | 7950 | 0.10 | >4.00 |
| VI | 15 | 20800 | 0.12 | >4.00 |

EXAMPLE 4

A homodisperse gelatin/silver bromide emulsion is prepared by controlled double inflow of silver nitrate and potassium bromide solutions. The crystals have a cubic structure with a length of edge of about 0.15 micron. The emulsion is ripened for 1 hour at 55° C after the addition of $10^{-4}$ mole of $Na_3[Au(S_2O_3)_2]$ per mole of silver bromide. This emulsion serves as starting emulsion for preparing the silver halide emulsions that have a layered grain composition in accordance with the U.K. Pat. Specification 1,027,146. The grains consist of a chemically ripened core and a shell of silver halide.

The following aqueous solutions are added simultaneously to a portion of starting emulsion, which contains 0.5 mole of silver bromide while the pAg is kept at 8.0:

1170 ml of 3N silver nitrate solution and 1170 ml of a potassium halide solution which has a 2.55 molar concentration of potassium bromide and a 0.45 molar concentration of potassium iodide.

The homodisperse silver iodobromide emulsion obtained in this way contains cubic grains with an average grain diameter of about 0.3 micron and has a silver iodide content of 13.1 mole %, calculated on the total quantity of silver halide.

A comparison silver iodobromide emulsion with the same average grain size and silver iodide content of 9.6 mole % is prepared in the same conditions, the only exception being that the potassium halide solution has a 2.67 molar concentration of potassium bromide and a 0.33 molar concentration of potassium iodide.

Both emulsions are fogged in the conventional manner until they both have the same maximum density. The emulsions are then coated on a conventional film support. After exposure through a grey wedge and development for 5 minutes at 20° C in a developer of the following composition:

| | |
|---|---|
| p-methylaminophenol | 1 g |
| hydroquinone | 3 g |
| anhydrous sodium sulphite | 13 g |
| anhydrous sodium carbonate | 26 g |
| potassium bromide | 1 g |
| water up to | 1 litre |

it is found that the emulsion with 13.2 mole % of iodide has 5 times the speed of the comparison emulsion.

We claim:

1. Photographic material comprising at least one layer of a direct-positive radiation-sensitive emulsion having high sensitivity and good maximum density containing fogged homodisperse silver halide grains wherein at least 95% by weight of the silver halide grains of the emulsion have a diameter which is within about 40% of the mean grain diameter and wherein the silver halide of the grains has a silver iodide content of more than 10 mole % and at most about 20 mole % relative to the total amount of silver halide.

2. Photographic material according to claim 1, wherein the silver iodide content is comprised between about 12 and about 20 mole %.

3. Photographic material according to claim 1, wherein the said silver halide grains have been fogged by reduction sensitisation.

4. Photographic material according to claim 3, wherein the said silver halide grains have been fogged by treatment of the silver halide grains with a reducing agent.

5. Photographic material according to claim 4, wherein said reducing agent is thiourea dioxide or tin(II)chloride.

6. Photographic material according to claim 3, wherein the silver halide grains have been fogged by silver halide precipitation or digestion in low pAg and/or high pH conditions.

7. Photographic material according to claim 3, wherein fogging also occurs in the presence of a compound of a metal that is more electropositive than silver.

8. Photographic material according to claim 7, wherein said metal compound is a gold compound.

9. Photographic material according to claim 1, wherein the silver halide grains have in their interior ripening nuclei.

10. Photographic material according to claim 1, wherein the emulsion has been sensitized spectrally.

11. Method of producing direct-positive images, which comprises image-wise exposing and subsequently surface developing a direct positive material containing fogged homodisperse silver halide grains wherein at least 95% by weight of the silver halide grains of the emulsion have a diameter which is within about 40% of the mean grain diameter and wherein the silver halide of the grains has a silver iodide content of more than 10 mole % and at most about 20 mole % relative to the total amount of silver halide.

12. Method according to claim 11, wherein development occurs by means of a viscous processing liquid comprising an alkali-soluble polymeric thickening agent.

13. Method according to claim 12, wherein said thickening agent is carboxymethylcellulose.

* * * * *